US007671309B2

(12) United States Patent
Kumar et al.

(10) Patent No.: US 7,671,309 B2
(45) Date of Patent: Mar. 2, 2010

(54) MICROWAVE COMBUSTION SYSTEM FOR INTERNAL COMBUSTION ENGINES

(75) Inventors: Devendra Kumar, Rochester Hills, MI (US); Dominique Tasch, Mietingen (DE); Ramesh Peelamedu, Rochester Hills, MI (US); Satyendra Kumar, Troy, MI (US); David Brosky, Macomb, MI (US); Michael Gregersen, Warren, MI (US)

(73) Assignee: BTU International, Inc., North Billerica, MA (US)

( * ) Notice: Subject to any disclaimer, the term of this patent is extended or adjusted under 35 U.S.C. 154(b) by 520 days.

(21) Appl. No.: 11/518,857

(22) Filed: Sep. 11, 2006

(65) Prior Publication Data

US 2009/0266325 A1 Oct. 29, 2009

Related U.S. Application Data

(60) Provisional application No. 60/715,747, filed on Sep. 9, 2005.

(51) Int. Cl.
*H05B 6/76* (2006.01)
*F02B 1/00* (2006.01)
*F23Q 7/00* (2006.01)

(52) U.S. Cl. ..... 219/738; 219/268; 123/1 R

(58) Field of Classification Search ..... 219/736–744, 219/725–735; 123/275–299, 406.11–406.76, 123/1 R See application file for complete search history.

(56) References Cited

U.S. PATENT DOCUMENTS

| | | | | |
|---|---|---|---|---|
| 3,934,566 | A * | 1/1976 | Ward | 123/275 |
| 4,403,504 | A * | 9/1983 | Krage et al. | 73/114.29 |
| 4,437,338 | A * | 3/1984 | Wilson | 73/114.29 |
| 4,664,937 | A | 5/1987 | Ovshinsky et al. | |
| 4,897,285 | A | 1/1990 | Wilhelm | |
| 5,535,620 | A * | 7/1996 | Nichols | 73/114.69 |
| 5,672,975 | A * | 9/1997 | Kielb et al. | 324/644 |
| 6,520,142 | B2 | 2/2003 | Nogi et al. | 123/299 |

FOREIGN PATENT DOCUMENTS

| | | |
|---|---|---|
| EP | 0 055 877 A1 | 7/1982 |
| EP | 1 063 427 A2 | 12/2000 |
| GB | 1515148 | 6/1978 |
| WO | WO 95/27387 | 10/1995 |
| WO | WO 02/35886 | 5/2002 |

* cited by examiner

*Primary Examiner*—Daniel L Robinson
(74) *Attorney, Agent, or Firm*—Weingarten, Schurgin, Gagnebin & Lebovici LLP

(57) ABSTRACT

A microwave combustion system is presented that can replace the conventional spark plug in an internal combustion engine. One or more microwave pulses are provided to a microwave feed in a plug that sits in the cylinder. A microwave generated plasma generated by the plug in the vicinity of a fuel mixture can provide for highly efficient combustion of the fuel-air mixture.

32 Claims, 11 Drawing Sheets

MICROWAVE COMBUSTION SYSTEM FOR INTERNAL COMBUSTION ENGINES

CROSS REFERENCE TO RELATED APPLICATIONS

This application claims the benefit under 35 U.S.C. § 119(e) of U.S. Provisional Application No. 60/715,747, filed Sep. 9, 2005, the disclosure of which is incorporated by reference herein.

STATEMENT REGARDING FEDERALLY SPONSORED RESEARCH OR DEVELOPMENT

N/A

BACKGROUND OF THE INVENTION

In internal combustion engines, both the efficiency and pollution characteristics of the engine are highly dependent on the efficient combustion of the fuel-air mixture in the cylinders. Inefficient combustion results in loss of power (i.e., efficiency) and greater pollution due to incomplete fuel usage.

In conventional gas engines, the fuel-air mixture is ignited by a spark plug that provides a spark to the mixture when a high voltage (i.e. 10-30 kV) is applied across a spark gap of a spark plug. The application of the high voltage is timed for when the cylinder volume (and therefore the fuel-air mixture) is close to as low a volume as possible, i.e., close to Top-Dead-Center (TDC) or just before or after TDC. In that characteristic location, the fuel-air mixture is compressed as much as possible and the spark from the spark gap can ignite a flame that propagates through the volume of the cylinder. As is well known, multiple cylinder engines operate by timing the combustion of a fuel-air mixture in each cylinder appropriately.

In a conventional diesel engine, the fuel-air mixture is ignited by compression of the mixture in the cylinder to reach a flash point. Glow-plugs or other devices may be utilized to assist combustion, at least until the engine is warm enough that the fuel ignites at or near the end of the compression stroke alone.

Utilization of RF or microwave energy to enhance combustion has been proposed. (See, e.g., U.S. Pat. No. 3,934,566 to Ward). In the proposal of Ward, a continuous wave (CW) of RF or microwave energy can be supplied through a spark plug or glow plug while ignition of the fuel-air mixture is accomplished conventionally, i.e. by applying a high voltage across a spark-plug gap or by compressing the fuel-air mixture to its ignition point. Such a system is highly complicated as it requires both a microwave system and a conventional high-voltage delivery system to the spark plug.

Therefore, there is further need for systems that enhance the combustion of a fuel-air mixture in an internal combustion engine.

SUMMARY OF THE INVENTION

In accordance with the present invention, a microwave combustion system is disclosed that ignites a fuel mixture in a cylinder utilizing pulses of microwave energy. In some embodiments, one or more pulses of microwave energy are supplied to a plug inserted into the cylinder. In some embodiments, pre-treatment pulses and/or post-treatment pulses may be supplied to the plug in addition to those pulses that provide ignition.

A microwave combustion system according to some embodiments of the present invention includes a microwave source; a high-voltage pulse generator coupled between a high-voltage power supply and the microwave source, the high-voltage pulse generator providing a pulse of high voltage to the microwave source in response to a trigger signal; and a plug coupled to receive microwave energy from the microwave source when the pulse of high voltage is supplied to the microwave source. The trigger signal may be provided by a pulse generator coupled to a spark plug wire. The trigger signal may be provided on the downward edge of a high voltage transient spark signal provided on the spark plug wire. In another embodiment, the trigger signal may be provided by the engine control module.

The microwave combustion system may include a circulator coupled between the microwave source and the plug. The microwave combustion system may further include a dual directional coupler to help monitor forward and reverse propagating microwave energy coupled between the microwave source and the plug. The microwave combustion system may further include a tuner coupled between the microwave source and the plug.

The microwave energy may be coupled between the microwave source and the plug with a waveguide. The microwave combustion system may further include a waveguide to coaxial converter to couple microwave energy to a coaxial cable, which is coupled to the plug. A coaxial cable or a coaxial waveguide may connect the microwave source to the plug. The microwave source may also be directly connected and be a part of the plug.

The plug may include a microwave feed and a ground line. The ground line may be formed of a metal washer. The metal washer may include a series of holes around the central hole. The central hole of the metal washer may have a non-circularly shaped opening near the microwave feed. The ground line may be formed of a wire mesh. The ground line may be one or more tips arranged around the microwave feed.

A method of igniting a fuel mixture according to some embodiments of the present invention includes receiving a trigger signal related to the time for combustion in a cylinder; and providing, in response to the trigger signal, at least one pulse of microwave energy to a microwave feed of a plug coupled to the cylinder. Receiving a trigger signal may include receiving a signal from a spark plug wire into a pulse generator; and generating the trigger signal in response to the signal from the spark plug wire. Receiving a trigger signal may include receiving a signal from an engine control module. Providing at least one pulse of microwave energy may include generating a pulse train of high voltage pulses in response to the trigger signal; receiving the pulse train of high voltage pulses in a microwave source to generate a pulse train of microwave energy; and coupling the pulse train of microwave energy into the microwave feed. The pulse train may include one pulse. The pulse train may include one or more pulses of short duration followed by a pulse of long duration. The pulse train may include one or more pulses of low microwave power followed or preceded by a pulse of high microwave power.

DESCRIPTION OF THE DRAWINGS

The invention will be more fully understood from the following detailed description taken in conjunction with the accompanying drawings in which.

In the figures, elements having the same designation have the same or similar functions.

DETAILED DESCRIPTION OF THE INVENTION

Figure 1A:
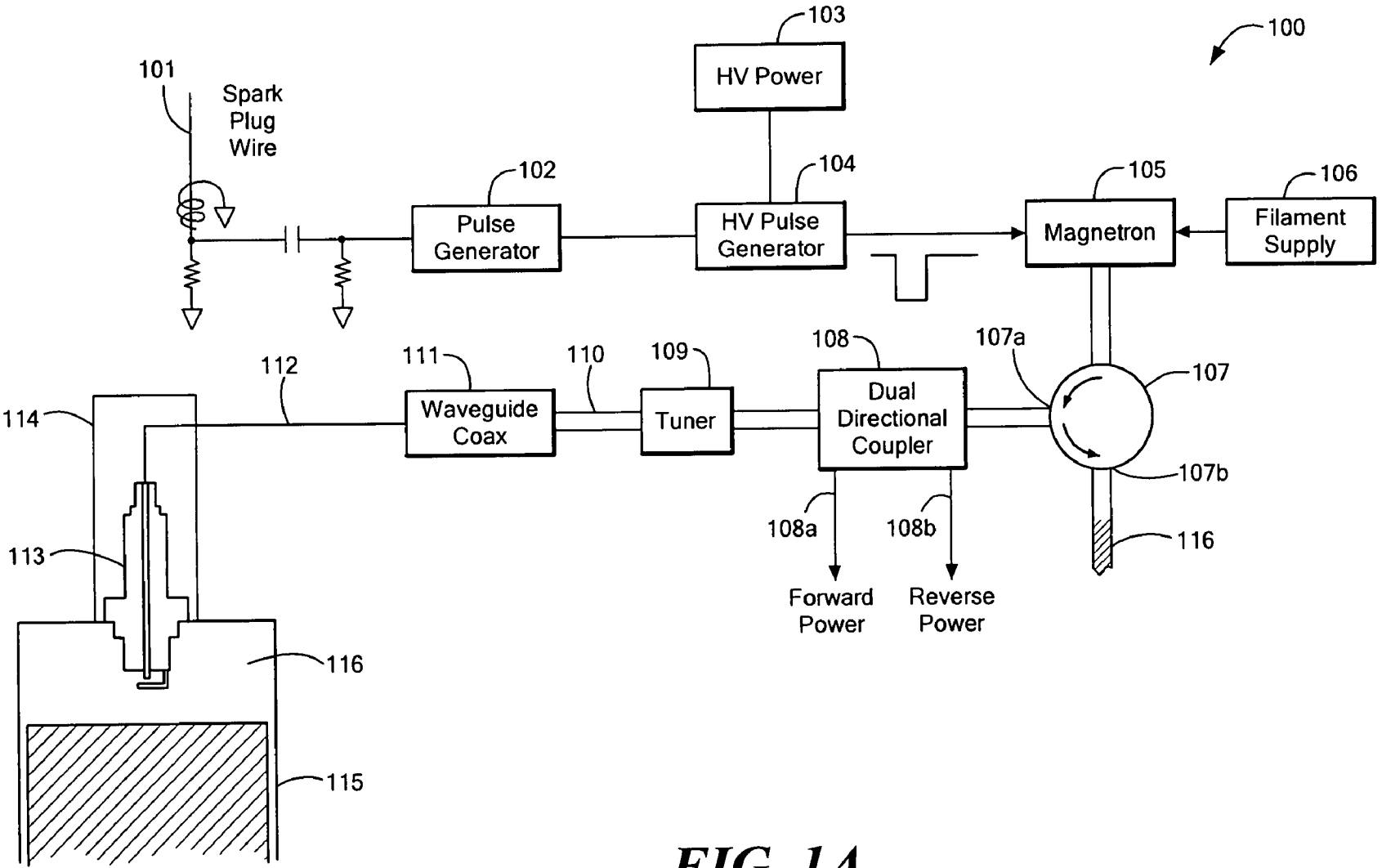
FIG. 1A shows a microwave combustion system according to some embodiments of the present invention.

FIG. 1A illustrates a microwave combustion system according to some embodiments of the present invention. An embodiment of the system illustrated in FIG. 1A, for example, has been utilized successfully to operate a single-cylinder lawnmower engine.

As shown in FIG. 1A, a spark plug wire 101 that would normally connect directly to a spark plug 113 and provide the necessary 10-30 kV high voltage pulse to generate a spark in volume 116 of a cylinder 115 is instead coupled to a pulse generator 102. In some embodiments, the pulse generator 102 may be coupled to an engine control unit or other pick-up synchronized with the rotation of the engine rather than to the spark plug wire 101. The pulse generator 102, in response to the downward edge of the pulse on spark plug wire 101, generates a control pulse to a high-voltage pulse generator 104. The pulse generator 104 can be a high voltage switching device that can couple a high voltage power supply 103 to a microwave source 105. The pulse generator 104 is coupled to the power supply 103 in order to supply the voltage to operate the microwave source 105. The power supply 103 can, for example, be about a 4000 V DC power supply. The microwave source 105 can be a magnetron, klystron, traveling wave tube, or any other source of microwave energy. For example, the present invention also contemplates the use of solid state microwave sources, which may not require such a high voltage as a magnetron or klystron. Also, the output of two or more solid state microwave sources can be combined to achieve larger power outputs.

In some embodiments of the invention, the pulse generator 104 can supply a voltage pulse train. The voltage pulse train can include pulses of different duration as well as pulses having different voltages. The microwave source 105, then, generates a pulse train of microwave pulses of varying energies and pulse durations, depending on the duration and voltage of the pulses in the voltage pulse train. A filament voltage supply 106 is also coupled to the microwave source 105 to keep the filament of the microwave source 105 hot continuously. In some embodiments, the pulse generator 104 can include an induction coil.

In the system shown in FIG. 1A, microwave pulses from the microwave source 105 are coupled into a waveguide, which is then coupled to a circulator 107. Typically, a circulator is utilized to isolate the microwave source 105 from reflected microwave energy from the remainder of the system. As such, the microwave pulse is coupled into another waveguide at a first port 107*a* of circulator 107 whereas a second port 107*b* of the circulator 107 couples reflected energy entering the first port into a matched load 116.

Microwave pulses from the circulator 107 can then be coupled into a dual directional coupler 108 so that microwave power can be monitored in both the forward and reverse directions. Most of the power from the dual directional coupler 108 is coupled into a tuner 109, but some power is coupled into a first port 108*a* for monitoring forward power. Some of the reflected power entering dual directional coupler 108 from tuner 109 is coupled to a second port 108*b* for monitoring reverse power. The tuner 109 can be utilized to tune the microwave system so that the microwave power coupled in the forward direction is maximized and the reflected power is minimized. In the system shown in FIG. 1, the microwave power from the tuner 109 can be coupled to a waveguide 110.

The waveguide 110, which can be a flexible waveguide, can then be coupled to a central core of the plug 113 via a waveguide-to-coax transition, which is inserted into the top of the volume 116 of the cylinder 115. To provide better shielding and a coaxial-type energy feed, a metallic shield 114 may be placed around the spark plug 113.

In tests, microwave pulses of duration of 50 to 100 μs at a rate of up to 100 Hz were successful in producing a reliable spark at the tip of the plug 113, which in one example was derived from a conventional spark plug, when it was outside the engine. This rate of spark production would correspond to a rotation rate of about 12000 rpm for a 4-stroke engine.

In an operating example of microwave combustion system 100 shown in FIG. 1A, the power supply 103 was about a 4000 V DC power supply. The pulse generator 104 was a HV switch capable of coupling the HV power supply 103 to the microwave source 105 for up to about 100 μs at a time triggered with a TTL pulse from the pulse generator 102. The microwave source 105, when supplied with high voltage from the power supply 103, produced a 2.45 GHz microwave pulse of duration about 100 μs. The pulse generator 102 can be a Model DG 535, produced by Stanford Research Systems, Inc. The HV power supply 103 can be a Model SR6PN6, produced by Spellman High Voltage Electronics Corp. The HV pulse generator 104 can be a Model "Power Mod" Solid State Modulator with Pulse Control Unit, produced by Diversified Technologies, Inc. The microwave source 105 can be a Model TMO20, produced by Alter, Italy. The filament supply 106 can be a Switching Power Generator PM740, produced by Richardson Electronics, Ltd. The circulator 107, directional coupler 108, and tuner 109 are standard microwave devices (e.g., the circulator 107 protects microwave source 105 from reflected power, the dual direction coupler 108 provides signals from which the forward and reflected microwave power can be measured, and the tuner 109 can be a 3-stub tuner to minimize reflections of microwaves due to mismatch of impedances further down the line). A reduction of the waveguide slightly from WR340 to WR248 can be accomplished at the tuner 109 so that a more flexible waveguide 110 of smaller size can be utilized. A waveguide/coax transition 111 feeds the microwave energy to the inner conductor of a coaxial cable 112 mounted on the side of the waveguide.

The plug 113 was derived from a conventional spark plug. The upper end of the spark plug was modified from that normally utilized with the spark plug wire 101. The upper, connector end can be reduced in size so that it fits tightly in the hole presented on the inner conductor of the coax connector. This allows for easy coupling of the microwave energy into the spark plug itself. A shield 114 can be a thin copper foil that is wrapped tightly around the outer conductor of the coaxial connector of the waveguide/coax transition 111 and at one end of the hexagonal metallic base of the plug 113. When the plug 113 is coupled with the cylinder head of the cylinder 115, the copper foil of the shield 114 can form the outer conductor of a coaxial waveguide. Additionally, the gap of the spark plug utilized for the plug 113 was slightly reduced to facilitate better sparking with microwave pulses.

The operating example described above succeeded in operating a lawn mower engine. The microwave pulse power was limited to 8 kW in the standard pulse mode. Additionally, the maximum pulse duration was 100 microseconds. An intrinsic delay of about 2 microseconds was measured between arrival of a spark pulse on the spark plug wire 101 and delivery of a microwave pulse at the spark plug 113.

As shown in FIG. 1A, a signal is received from the spark plug wire 101. In some embodiments, a pick-up coil can be wound on the outer sheath of spark plug wire 101 to pick up the trigger pulse for eventual firing of the microwave source. The trigger pulse is connected to pulse generator 102 for proper shaping and then fed to the HV pulse generator 104. The spark plug voltage to a standard spark plug is generally negative; therefore the pulse generator 102 produces pulses on the falling edge of the trigger pulse picked up from the spark plug wire 101. This ensures minimal delay between the time when the spark plug 113 would normally be fired, i.e. by spark plug wire directly, and the time that a pulse train of one or more microwave pulses is supplied to the spark plug 113. In a particular example, the intrinsic delay was measured at about 2 microseconds, which is negligible for an engine running at a few thousand RPMs.

Figure 2:
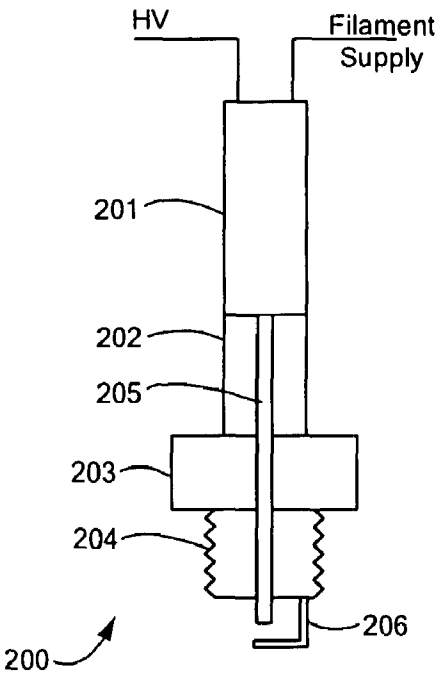
FIG. 2 illustrates a plug that can be utilized with some embodiments of the present invention.

In general, a microwave combustion system according to embodiments of the present invention will not need many of the elements shown in the text example of FIG. 1A, especially the microwave components. FIG. 2 illustrates a proposed plug 200 that can be coupled directly in place of microwave source 105 as shown in FIG. 1A. Such a plug, with the addition of the pulse generator 102, power supply 103, pulse generator 104, and filament supply 106, can directly replace spark plugs in conventional engines. As shown in FIG. 2, the plug 200 includes a microwave source 201, a fusible link 202, a microwave feed 205, and a ground electrode or line 206. The plug 200 is screwed into an engine block by threads 204 until base 203 is flush with the top of a cylinder head. The filament power supply 106 can be directly supplied to the microwave source 201. Further, pulses from the pulse generator 104 can be supplied to the microwave source 201. In some embodiments, the microwave source 201 can be removed, exposing fusible links 202 that can be directly coupled to a spark plug wire 101. In operation, microwave energy is radiated in the gap between the microwave feed 205 and the ground line 206. If the pulse contains sufficient microwave energy, a plasma can be excited in the gap. In some modes of operation, microwave pulses that do not excite a plasma can be utilized to pre-excite the fuel mixture, which can be a fuel-air mixture, provided in the volume 116 before a pulse that ignites a plasma is provided. Such an operation, with a pulse train of shaped microwave pulses, can be optimized to efficiently and cleanly control the combustion of the fuel mixture provided in the volume 116.

Figure 1B:
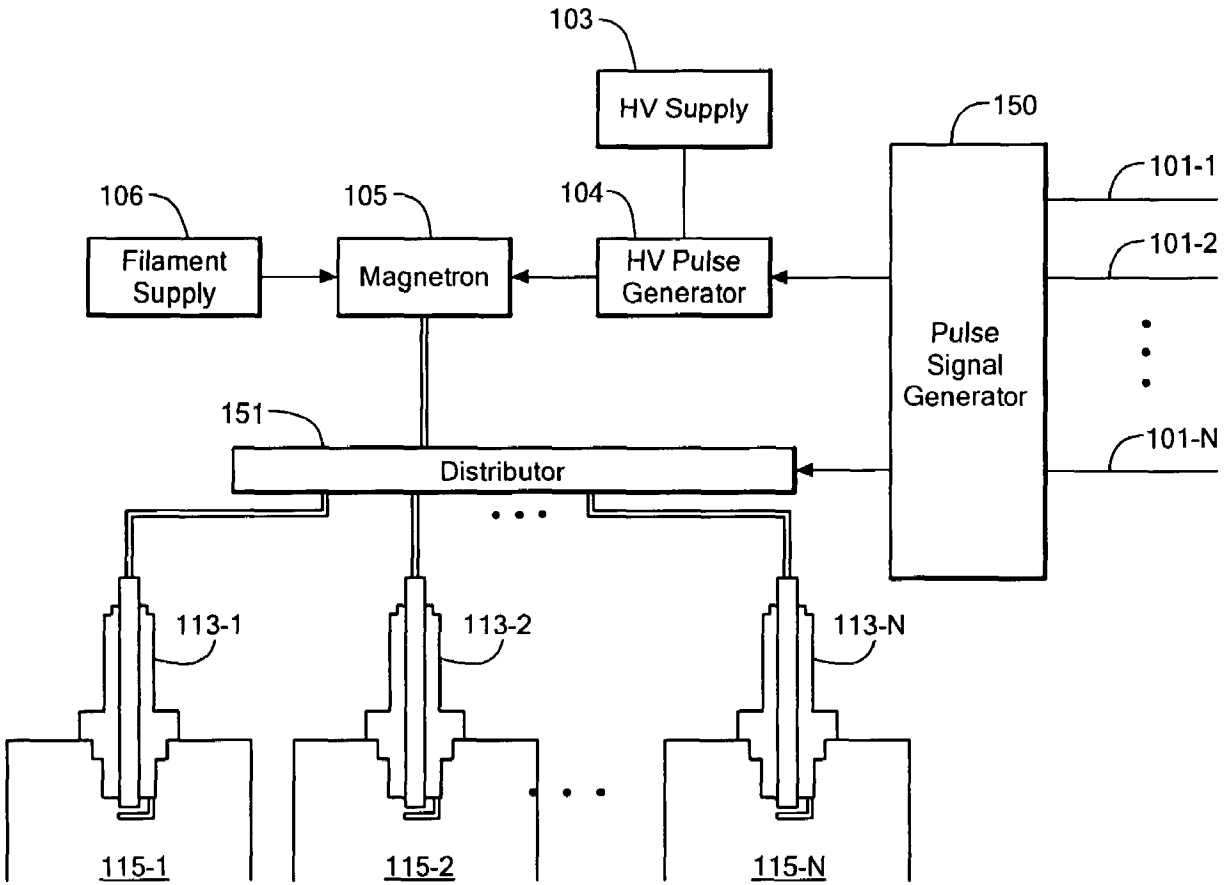
FIG. 1B shows a microwave combustion system in a multi-cylinder engine according to some embodiments of the present invention.

A multi-cylinder engine can be configured by replacing the spark plug of each cylinder by the microwave combustion system 100 illustrated in FIG. 1A. FIG. 1B illustrates a multi-cylinder microwave combustion system that shares a single microwave source. As shown in FIG. 1B, the microwave source 105 is coupled to each of N plugs 113-1 through 113-N through a microwave distributor 151. Spark plug wires 101-1 through 101-N are coupled to a pulse and signal generator 150, which both generates the pulses that drive the pulse generator 104 and provides a selection signal to the distributor 151 that indicates which of the plugs 113-1 through 113-N receives the microwave pulse train from the microwave source 105. As indicated in FIG. 1B, the pulse generator 104 receives a trigger signal when the fuel mixture in each of cylinders 115-1 through 115-N is to be ignited. The selection signal to the distributor 151 routes the microwave pulse train generated by the microwave source 105 to the proper one of the cylinders 115-1 through 115-N.

FIGS. 1A and 1B both illustrate a gas internal combustion engine. In a diesel engine, the spark plug wires 101 are replaced by signal wires from an engine control module. Further, the plugs 113 more closely resemble glow plugs than spark plugs. Microwave energy is radiated from coils between the engine block and the microwave feed instead of supplying a gap.

Figure 8:
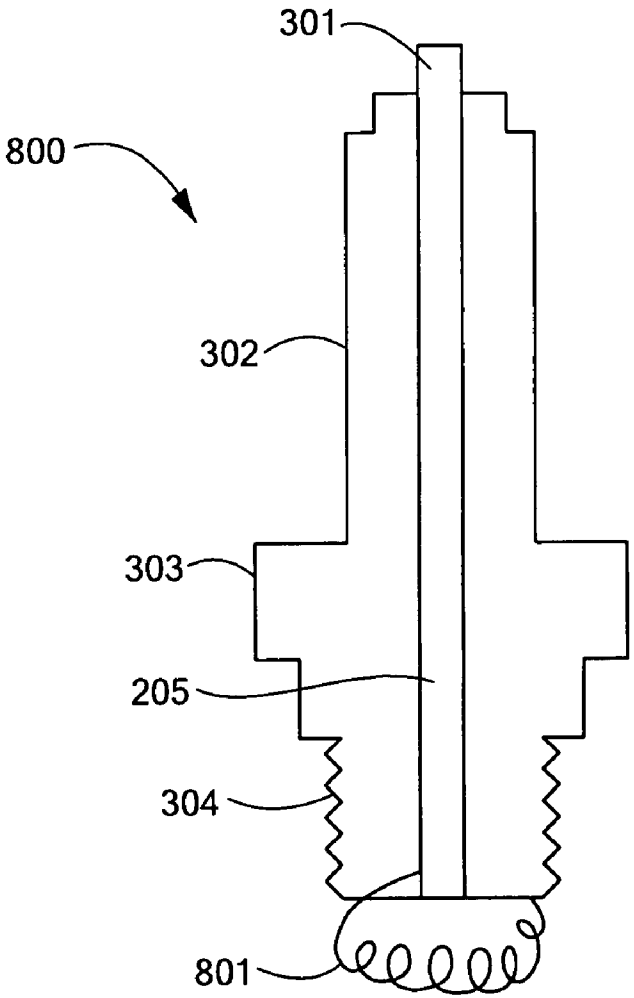
FIG. 8 illustrates a plug tip design that can be utilized in diesel engines according to embodiments of the present invention.

One factor that may contribute to coupling of microwave energy into the fuel mixture supplied in the volume 116, either to ignite a plasma or to excite the mixture, is the shape of plug 200 around the end of the microwave feed 205, especially the gap between the microwave feed 205 and the ground line 206. FIGS. 3A through 7 illustrate various examples of configurations for this gap area. FIG. 8 illustrates a plug 800 that can be utilized in a diesel engine. Other devices and configurations can be used to transfer energy to a spark gap in addition to those specifically shown and described herein.

Figure 3A:
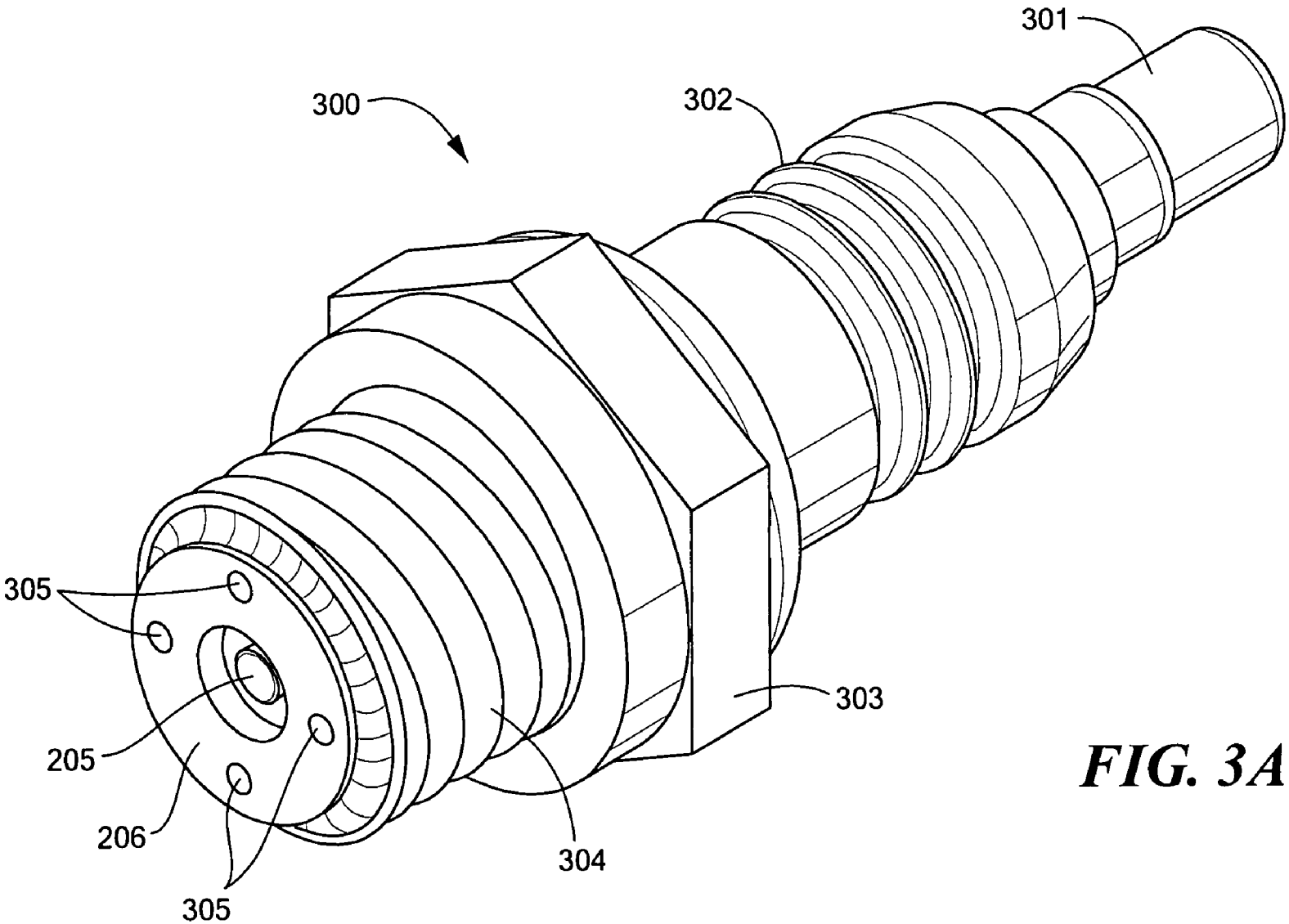
FIGS. 3A through 3C illustrate a plug tip design that can be utilized with some embodiments of the present invention.
Figure 3C:
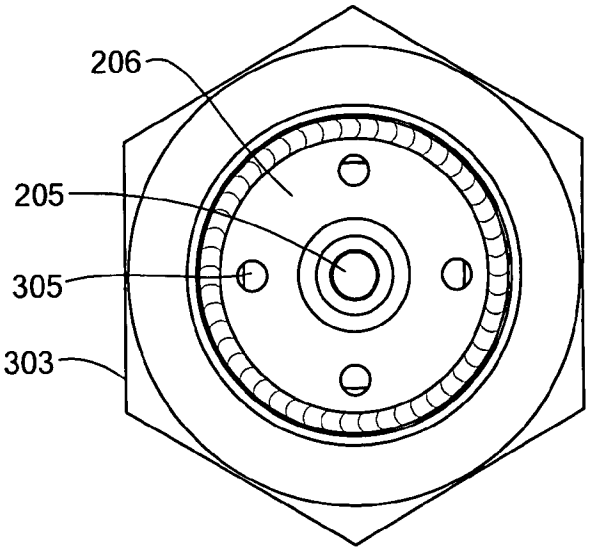
Figure 3B:
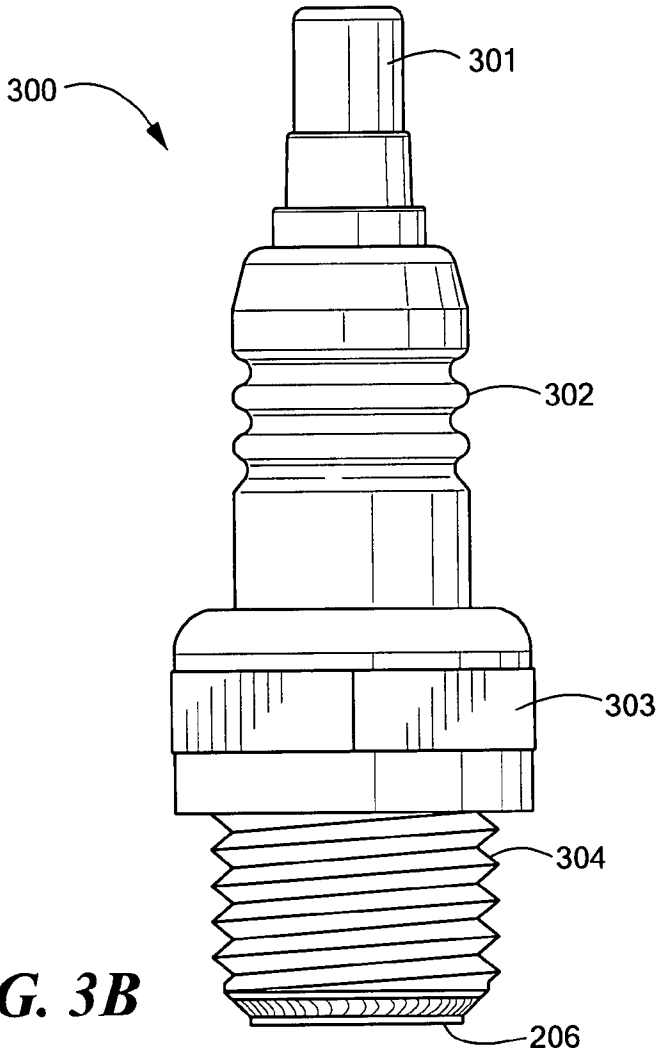
Figure 6A:
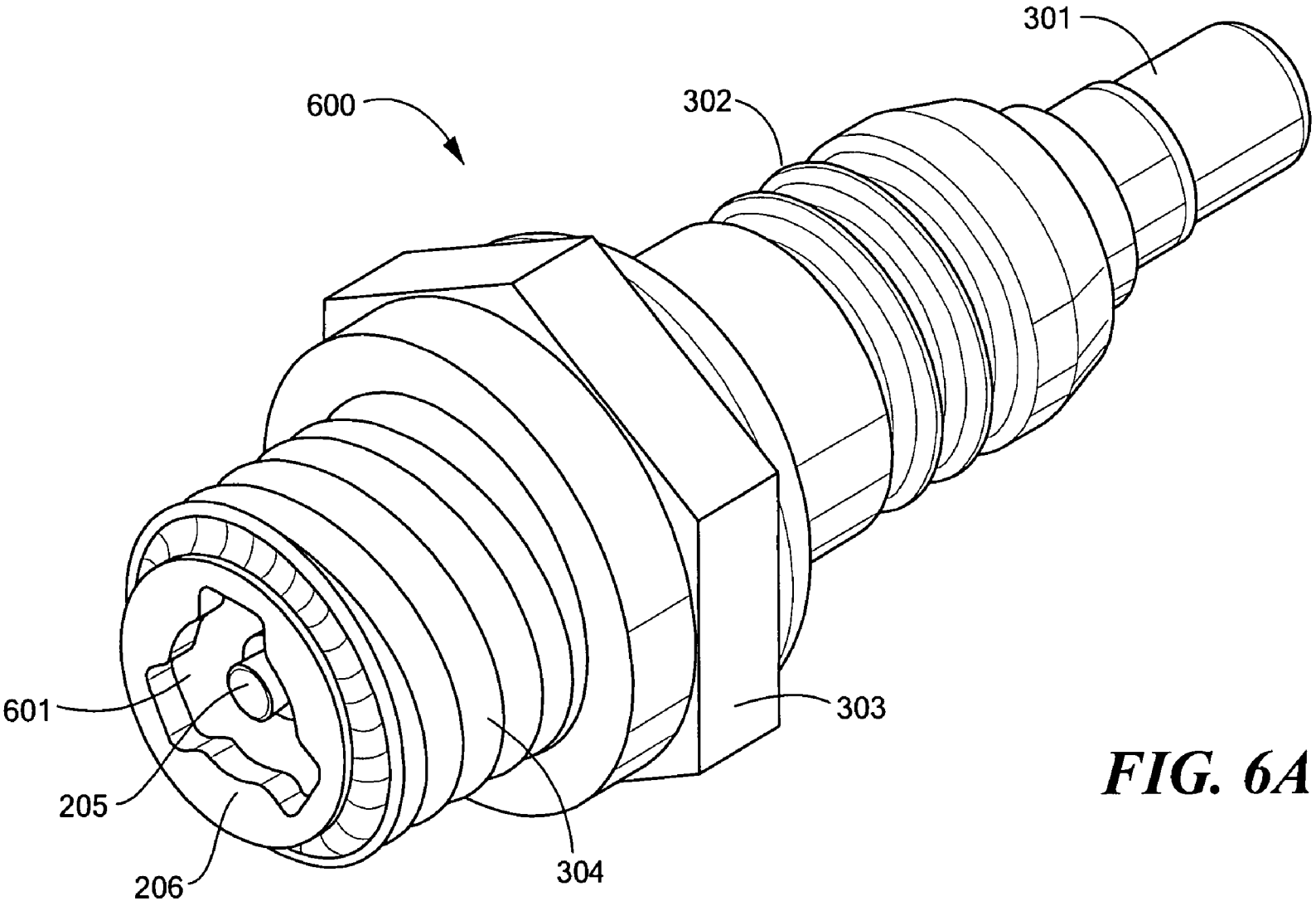
FIGS. 6A through 6C illustrate another plug tip design that can be utilized with some embodiments of the present invention.
Figure 6C:
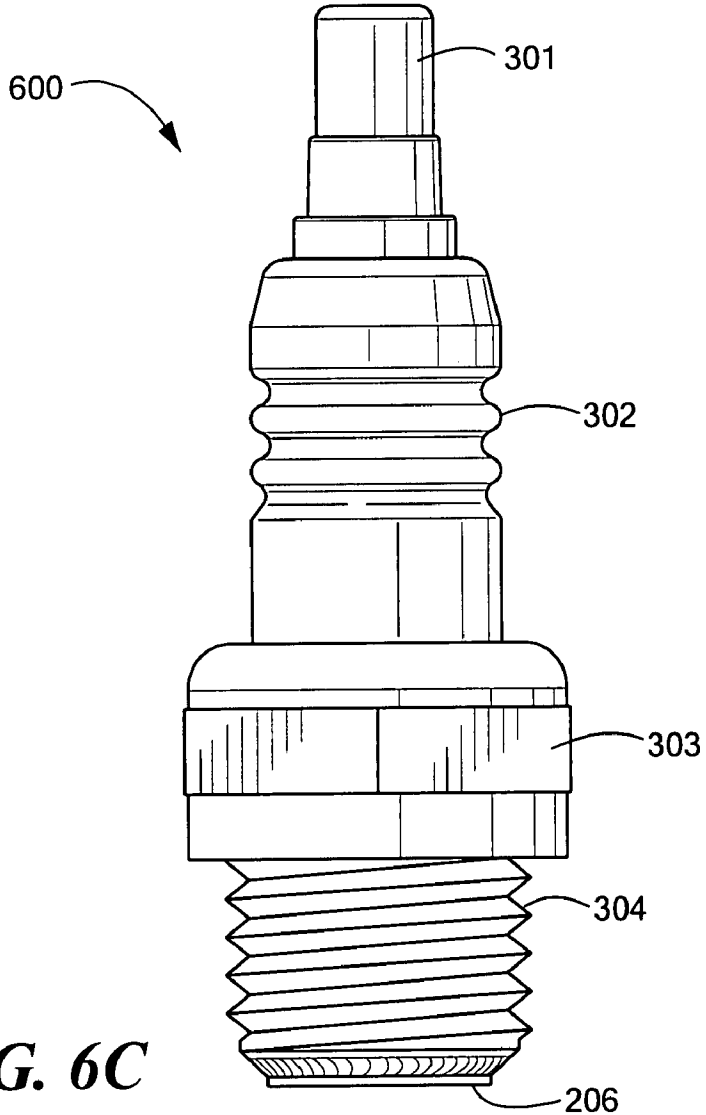

FIGS. 3A through 6C illustrate some example embodiments of plugs that may be utilized in some embodiments of the present invention. FIGS. 3A through 3C illustrate example plug 300, FIGS. 4A through 4C illustrate example plug 400, FIGS. 5A through 5C illustrate example plug 500, FIGS. 6A through 6C illustrate example plug 600, and FIG. 7 illustrates example plug 700. Example plugs 300, 400, 500, 600, and 700 differ in the configuration of the gap region between the microwave feed 205 and the ground line 206. In general, plugs according to the present invention can be any device that efficiently transmits microwave pulse power into a gap region in order to either excite the fuel mixture or ignite a plasma in the fuel mixture. Igniting a plasma in the fuel-air mixture initiates combustion of the fuel mixture. FIG. 8 illustrates an example plug 800 that can be utilized in a diesel engine.

The plug 300 as shown in FIG. 3A, for example, includes a tip 301, which can be microwave source 201 or a conducting tip such as that on the spark plug 113. In either case, microwave energy is supplied to the microwave feed 205 by the tip 301. The microwave feed 205 is surrounded by a ceramic insulator 302. The plug 300 can be mounted in the cylinder head of the cylinder 115 with threads 304. The plug 300 is typically inserted into the cylinder head until hexagonal base 303 is in electrical and physical contact with the cylinder head of the cylinder 115.

As shown in FIGS. 3A through 3C and 5A through 5C, the ground line 206 is formed of an annular metal member or washer pre-drilled with a number of holes. In the plug 300 of FIGS. 3A through 3C, the ground line 206 includes 4 holes 305. In the plug 500 of FIGS. 5A through 5C, the ground line 206 includes 3 holes 501. In general, any number of holes can be utilized. Further, the size of the holes may vary. The holes 305 and 501 allow the fuel mixture to easily go to the back side of the annular member for better contact with the plasma created by a microwave pulse between the ground line 206 and the microwave feed 205. Holes of 1 mm or less may be utilized to trap microwave energy in the gap between the ground line 206 and the microwave feed 205 in order to enhance production of the plasma in that region. The annular member with preset holes utilized to form the ground line 206 in the plugs 300 and 500 can be welded to the base of the plugs 300 and 500, respectively, just below the threads 304.

Figure 4A:
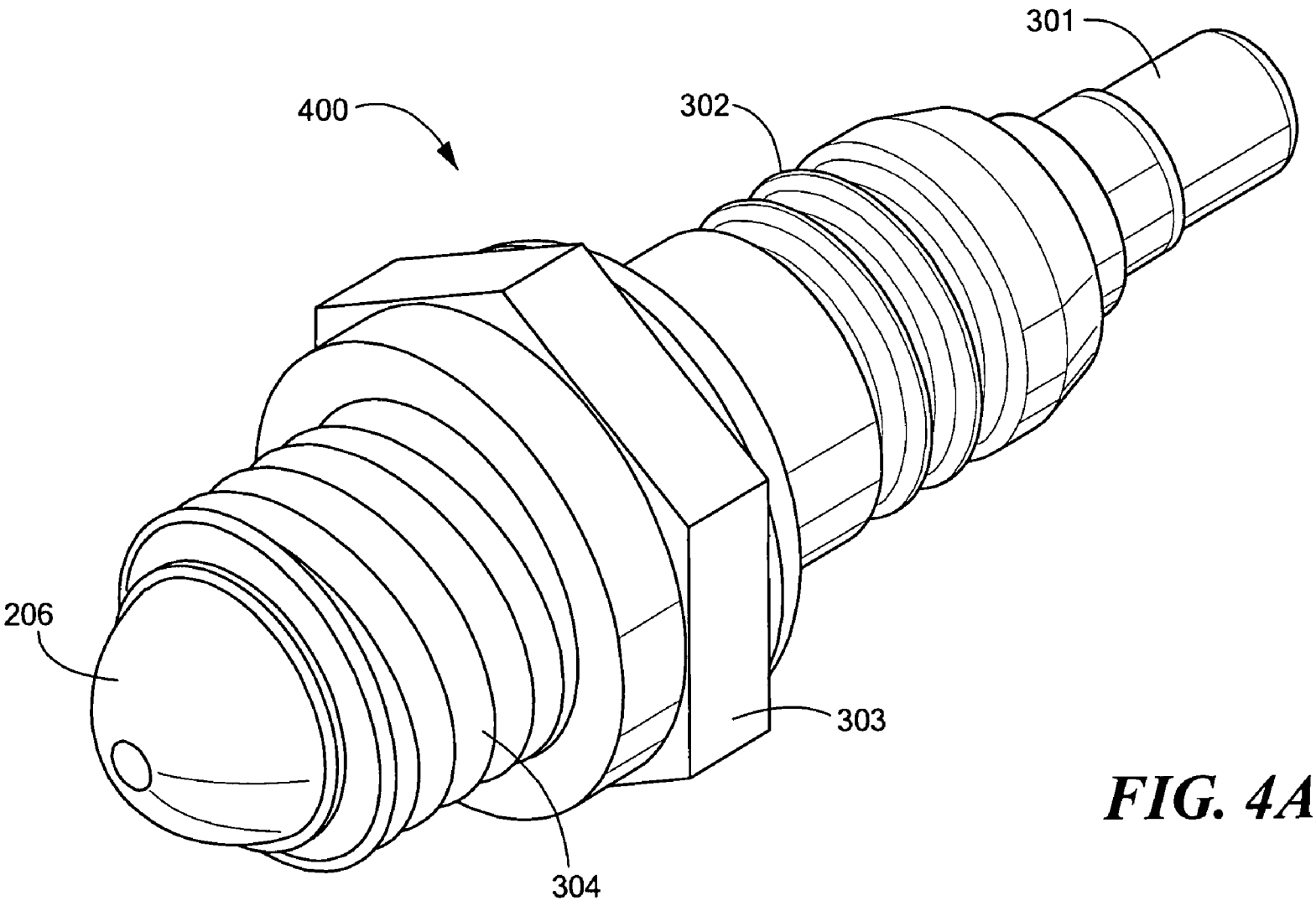
FIGS. 4A through 4C illustrate another plug tip design that can be utilized with some embodiments of the present invention.
Figure 4C:
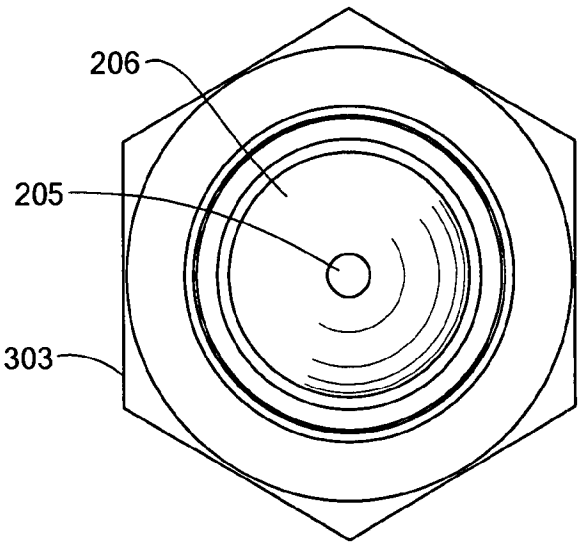
Figure 4B:
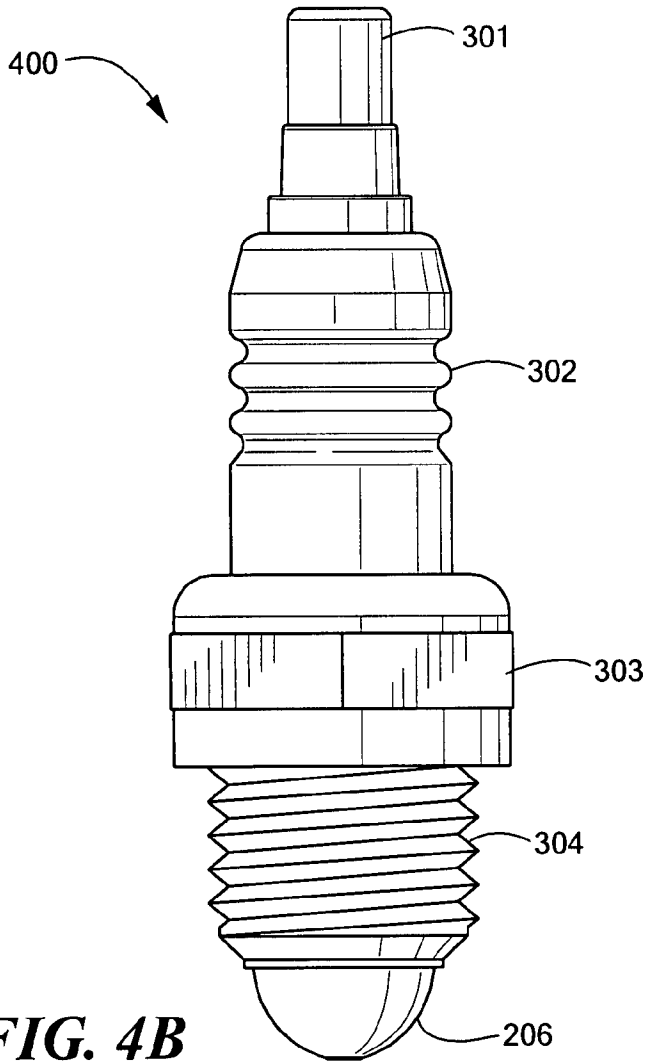
Figure 5B:
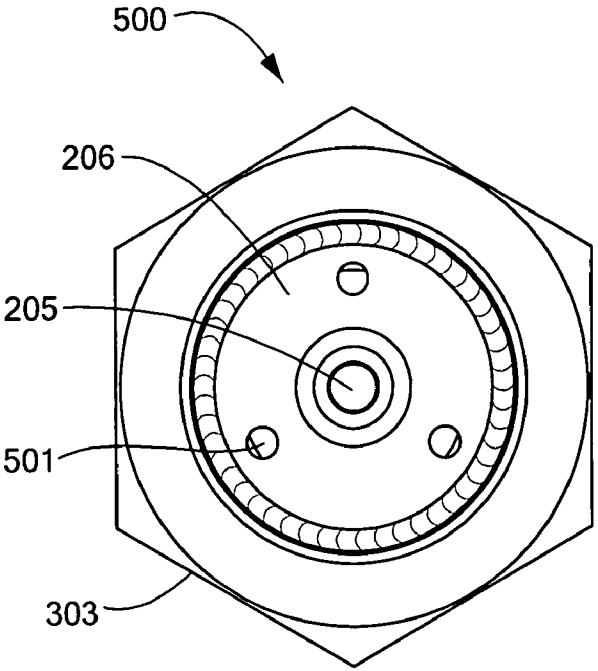
FIGS. 5A through 5C illustrate another plug tip design that can be utilized with some embodiments of the present invention.
Figure 5A:
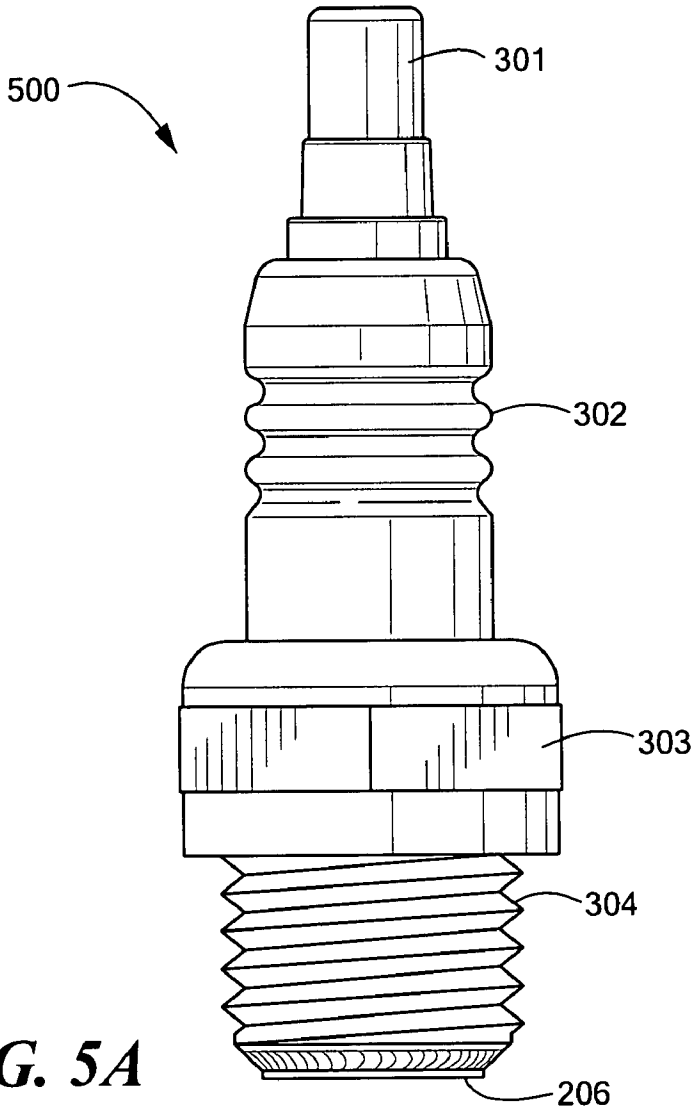
Figure 5C:
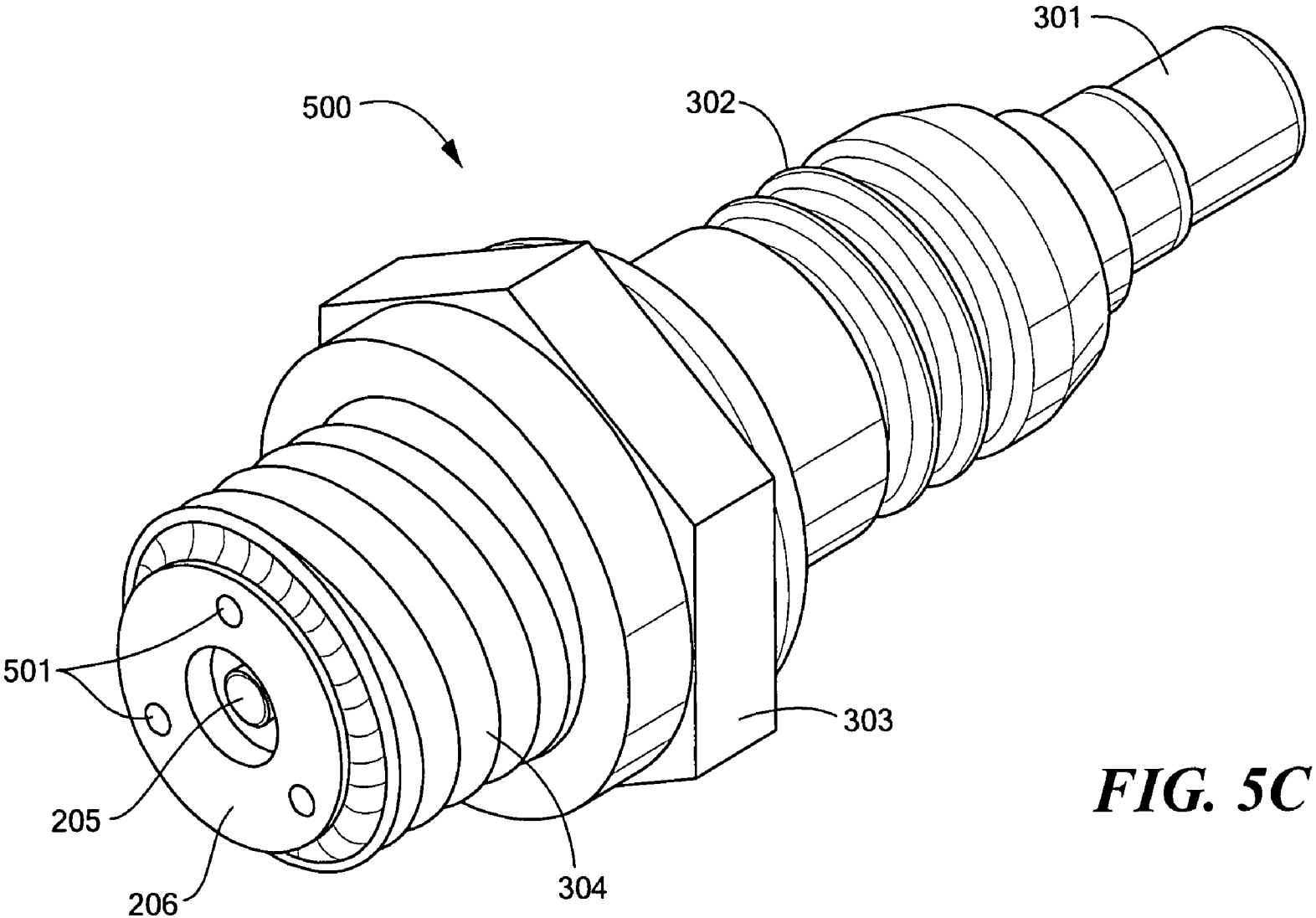

In the plug 400 of FIGS. 4A through 4C, the ground line 206 is formed of a thin metal mesh or screen welded to the base near the threads 304. The mesh (or screen) is generally dome (convex) shaped and can allow a controlled amount of microwave radiation to radiate from the screen. The size of the holes in the mesh can control the radiation output.

Figure 6B:
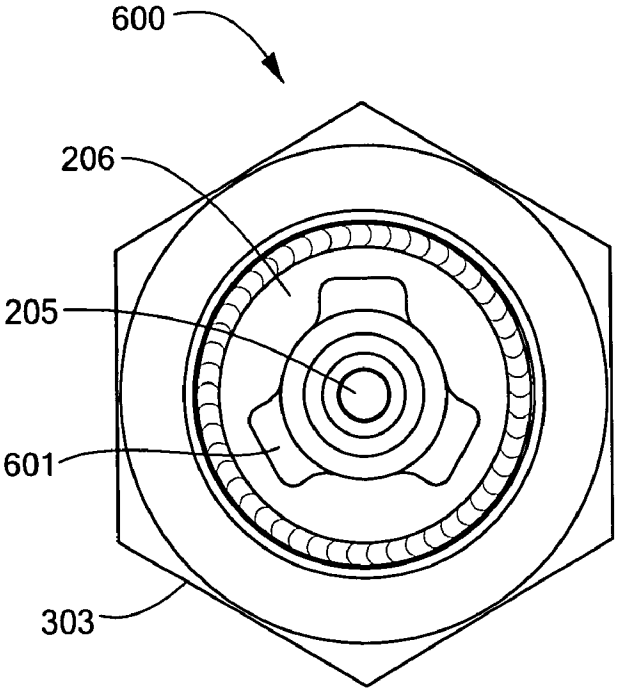
Figure 7:
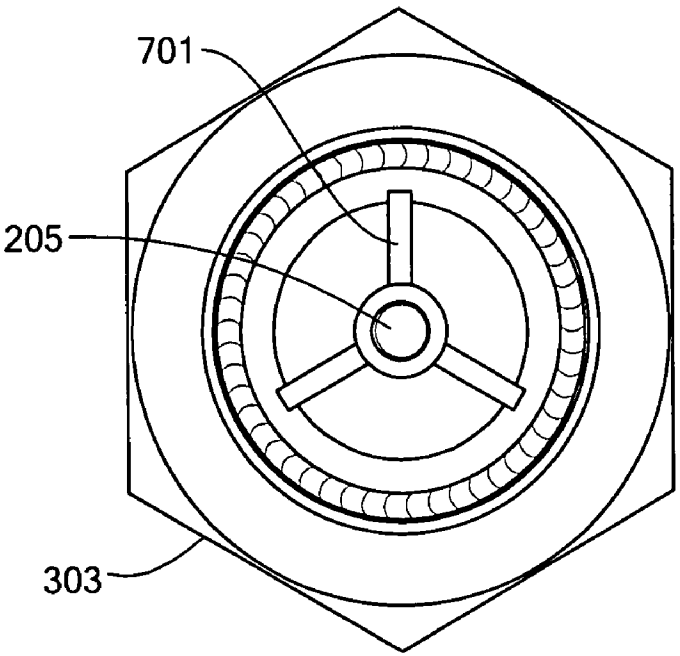
FIG. 7 illustrates another plug tip design that can be utilized with some embodiments of the present invention.

In the plug 600 of FIGS. 6A through 6C, the ground line 206 is formed of a metal annular member or washer with an opening 601 formed in the washer. As before, the metal washer is welded to the base of the plug 600 below the threads 304. The shape of the opening 601 can be formed to optimize leakage of microwave energy into the fuel mixture while retaining microwave energy to ignite a plasma in the gap formed between the ground line 206 and the microwave feed 205.

Variations of the example plugs illustrated in FIGS. 3A through 6C can be made. For example, as shown in the plug 700 of FIG. 7, the ground line 206 can be formed of multiple tips 701 spaced around the microwave feed 205. In some embodiments, the ground electrode 206 can be formed of 2, 3, or 4 ground electrodes spaced about the microwave feed 205. In some embodiments, the separate ground electrodes can be symmetrically placed about the microwave feed 205 (i.e., 2, 3, or 4 ground electrodes placed 180, 120, or 90 degrees apart around the microwave feed 205). In general, the ground line 206 can be formed to be able to ignite the fuel mixture in a reliable manner with the microwave induced plasma, as well as also allowing a controlled amount of microwave energy to leak out to help improve the overall ignition process.

FIG. 8 illustrates a plug 800 that can be utilized in a diesel engine. The plug 800 includes an antenna or coil 801 that radiates microwave energy into a cylinder when microwave power is applied to a microwave feed 205. The plug may include one or more wires or thin metallic strips connected between the central microwave feed conductor 205 and the outer ground body. Additionally, the plug 800 may be capable of function as a standard glow plug.

As suggested before, a microwave system according to the present invention can utilize a pulse train of microwave pulses. Short duration pulses or lower energy pulses that do not ignite a plasma can be provided to pre-treat the fuel mixture to help improve the combustion process. A high energy, longer duration, pulse that ignites a plasma then can help provide a more efficient combustion of the fuel mixture.

The combustion system of the present invention is also operable over a wider range of the electromagnetic spectrum. For example, a spark, and hence ignition, can also be produced by pulses of RF frequency lower than the microwave frequency range, such as UHF, VHF, etc. Solid state power sources are operable at such RF frequencies and can be used in such applications.

The invention is not to be limited by what has been particularly shown and described, except as indicated by the appended claims.

What is claimed is:

1. A microwave combustion system, comprising:

a microwave source;

a first pulse generator configured to receive a trigger pulse synchronized with an internal combustion engine and configured to output a control pulse as a function of the trigger pulse;

a second pulse generator coupled to the first pulse generator to receive the control pulse and coupled between a power supply and the microwave source, the second pulse generator providing a voltage pulse of sufficient voltage to the microwave source in response to the control pulse; and a plug coupled to receive microwave energy from the microwave source when the voltage pulse is supplied to the microwave source.

2. The system of claim 1, wherein the first pulse generator is coupled to a spark plug wire.

3. The system of claim 2, wherein the first pulse generator provides the control pulse on a downward edge of a high voltage transient spark signal provided on the spark plug wire.

4. The system of claim 1, wherein the trigger pulse is provided by an engine control module.

5. The system of claim 1, wherein the second pulse generator comprises a high voltage pulse generator.

6. The system of claim 1, further including a circulator coupled between the microwave source and the plug.

7. The system of claim 1, further including a dual directional coupler to monitor forward and reverse propagating microwave energy coupled between the microwave source and the plug.

8. The system of claim 1, further including a tuner coupled between the microwave source and the plug.

9. The system of claim 1, wherein microwave energy is coupled between the microwave source and the plug with a waveguide.

10. The system of claim 9, further including a waveguide to coaxial transition to couple microwave energy to a coaxial cable, which is coupled to the plug.

11. The system of claim 1, wherein the microwave source is coupled to the plug with a coaxial cable.

12. The system of claim 1, wherein the microwave source is coupled to the plug with a coaxial waveguide.

13. The system of claim 1, wherein the microwave source is directly connected, and is part of, the plug.

14. The system of claim 5, wherein the high voltage pulse generator includes an induction coil.

15. The system of claim 1, wherein the plug includes a microwave feed and a ground line.

16. The system of claim 15, wherein the ground line comprises an annular metal member having a central opening.

17. The system of claim 16, wherein the annular metal member includes a series of holes distributed about the central opening.

18. The system of claim 16, wherein the central opening of the annular metal member is shaped to form a non-circular opening near the microwave feed.

19. The system of claim 15, wherein the ground line comprises a wire mesh.

20. The system of claim 15, wherein the ground line comprises one or more tips distributed around the microwave feed.

21. The system of claim 20, wherein the one or more tips are symmetrically distributed around the microwave feed.

22. The system of claim 1, wherein the plug includes a microwave antenna coupled between a microwave feed and a ground.

23. The system of claim 1, wherein the microwave source comprises a magnetron.

24. The system of claim 1, wherein the microwave source comprises a klystron.

25. The system of claim 1, wherein the microwave source comprises a traveling wave tube.

26. The system of claim 1, wherein the microwave source comprises a solid state device.

27. The system of claim 1, wherein the plug is coupled to a cylinder in the internal combustion engine.

28. The system of claim 27, wherein the plug receives only microwave energy from the microwave source in order to initiate combustion of a fuel-air mixture within the cylinder of the internal combustion engine.

29. A microwave combustion system, comprising:

a microwave source;

a first pulse generator coupled to a spark plug wire and configured to output a control pulse;

a second pulse generator coupled to the first pulse generator to receive the control pulse and coupled between a power supply and the microwave source, the second pulse generator providing a voltage pulse of sufficient voltage to the microwave source in response to the control pulse; and a plug coupled to receive microwave energy from the microwave source when the voltage pulse is supplied to the microwave source, wherein the first pulse generator provides the control pulse on a downward edge of a high voltage transient spark signal provided on the spark plug wire.

30. A microwave combustion system, comprising:

a microwave source;

a pulse generator coupled between a power supply and the microwave source, the pulse generator providing a voltage pulse of sufficient voltage to the microwave source in response to a control pulse;

a plug coupled to receive microwave energy from the microwave source when the voltage pulse is supplied to the microwave source; and a dual directional coupler to monitor forward and reverse propagating microwave energy coupled between the microwave source and the plug.

31. A microwave combustion system, comprising:

a microwave source;

a pulse generator coupled between a power supply and the microwave source, the pulse generator providing a voltage pulse of sufficient voltage to the microwave source in response to a control pulse; and a plug, including a microwave feed and a ground line, coupled to receive microwave energy from the microwave source when the voltage pulse is supplied to the microwave source, wherein the ground line comprises an annular metal member having a series of holes distributed about a central opening.

32. A microwave combustion system, comprising:

a microwave source;

a pulse generator coupled between a power supply and the microwave source, the pulse generator providing a voltage pulse of sufficient voltage to the microwave source in response to a control pulse; and a plug, including a microwave feed and a ground line, coupled to receive microwave energy from the microwave source when the voltage pulse is supplied to the microwave source, wherein the ground line comprises one or more tips symmetrically distributed around the microwave feed.

* * * * *